US005345650A

United States Patent [19]

Downham et al.

[11] Patent Number: 5,345,650

[45] Date of Patent: Sep. 13, 1994

[54] VACUUM CLEANERS

[75] Inventors: David W. Downham, Flitwick; Andrew G. Hoyte, Hatfield, both of United Kingdom

[73] Assignee: Electrolux Limited, United Kingdom

[21] Appl. No.: 39,835

[22] Filed: Mar. 30, 1993

[30] Foreign Application Priority Data

Apr. 2, 1992 [GB] United Kingdom ..... 9207291

[51] Int. Cl.[5] ..... A47L 5/28

[52] U.S. Cl. ..... 15/331; 15/387

[58] Field of Search ..... 15/387, 345, 331

[56] References Cited

U.S. PATENT DOCUMENTS 2,331,692 10/1943 Hunt ..... 15/345 X
3,704,482 12/1972 Brannon ..... 15/387 X
5,168,599 12/1992 Williams ..... 15/387 X

FOREIGN PATENT DOCUMENTS 3904289 8/1990 Fed. Rep. of Germany ..... 15/387

*Primary Examiner*—Chris K. Moore
*Attorney, Agent, or Firm*—Pearne, Gordon, McCoy & Granger

[57] ABSTRACT

The present invention relates to vacuum cleaners which may be in the form of so-called upright and cylinder cleaners. In the vacuum cleaner according to the invention the functions of air movement and rotation of a rotary beater or brush are separated. This results in a more flexible product, less possibility of damage to a belt driving the beater and gives a ready means for stopping the beater when the cleaner is parked. The vacuum cleaner includes a main body, a first portion and an electric fan housing coupled to a first aperture of an air duct, the first portion including a suction opening adjacent a beating means, a turbine coupled to a second aperture of the air duct and a drive line coupling between the turbine and the beating means, whereby cleaned air is directed through the duct to the turbine.

12 Claims, 5 Drawing Sheets

VACUUM CLEANERS

BACKGROUND OF THE INVENTION

This invention relates to vacuum cleaners.

Vacuum cleaners, especially vacuum cleaners for domestic as opposed to industrial use are frequently classified into two groups, namely, so-called upright cleaners and cylinder cleaners. Upright cleaners which, apart from the possible addition of optional accessories, may be regarded as self contained units in the sense that, all components, such as a motorized fan/suction unit, suction head, dust collecting reservoir, handle and all controls are housed within or on a single wheeled or otherwise manually displaceable unit. On the other hand, a hand held and controlled suction head in a cylinder cleaner is connectable via a flexible hose to a wheeled or otherwise displaceable unit which houses all moving and driven components such as a motorized fan/suction unit and, usually, a dust collecting reservoir. In the cleaners of each group, the dust collecting reservoir is customarily fitted with an air-permeable dust collecting bag which can be emptied and re-used, or include means for housing a disposable air-permeable dust collecting bag.

Although specific reference will be made in the following disclosure to upright vacuum cleaners, the concept of the present invention may also be applied to cylinder cleaners as well as vacuum cleaners for industrial and commercial use. Vacuum cleaners for industrial use are normally constructed similar to cylinder cleaners but, having regard to the environment in which they are required to operate, they are much heavier and more robust machines.

Upright vacuum cleaners conventionally include an impact imparting element which serves to disturb or release dust, etc., from a surface being cleaned so that it may be more easily sucked into the cleaner through a vacuum such dust and dirt or suction nozzle. The impact imparting element takes different forms including a rotatable brush or beater.

A partial vacuum is established at the vacuum or suction nozzle by the motorized fan which also serves to blow or suck air through a filter and the dust collector bag.

The air is led to an inlet for the fan through a relatively narrow nozzle which thus creates the partial vacuum in the cleaner. Usually, power for the beater is taken from a pulley on the fan motor shaft via a drive belt. This arrangement has several inherent disadvantages. The use of pulleys to drive the beater limits the choice of possible physical arrangements for the fan motor and beater. The belt is often vulnerable to damage. In addition, it is useful to be able to stop the motion of the beater when the vacuum cleaner is stationary to reduce wear on, for example, being cleaned, a carpet. This is not easily achieved in a conventional belt driven system.

SUMMARY OF THE INVENTION

An object of the present invention is to solve at least some of the above problems.

According to a first aspect of the invention, an upright vacuum cleaner comprises a main body, a lower portion and an electric fan housing coupled to a first aperture of an air duct, the lower portion including a suction opening adjacent a beating means, a turbine coupled to a second aperture of the air duct and a mechanical coupling between the turbine and the beating means. Preferably, the suction opening is arranged, in use, to be directed generally downwardly towards a surface to be cleaned.

Preferably, the first aperture of the air duct is coupled to an exhaust outlet of the fan housing. The air duct preferably includes a valve operable automatically substantially to redirect air away from the turbine when the angle between the main body and the lower portion falls within a predetermined range, thus allowing the beating means to come to rest. The beating means is preferably a rotary beating means and the turbine preferably has a pulley mounted coaxially on its shaft. A drive belt may be used to couple power from the turbine pulley to a pulley formed on the beating means. The valve is preferably a flap located in the duct, pivoting about fulcrum points in the upper surface of the duct and having a peg that cooperates with a groove formed in the main body to cause the flap to assume a predetermined angle in the duct in response to the angle between the main body and the lower portion.

It is another object of the present invention to provide a unit for use within a vacuum cleaner in which functions of air movement are separated from other functions, for example, in the case of an upright cleaner, drive to an impact imparting element. In the case of an upright cleaner such separation reduces the possibility of damage to a belt during operation of the impact imparting element and affords a beneficial method of stopping drive through the belt to the impact imparting element when the vacuum cleaner is stationary.

According to a second aspect of the invention, a unit for use within a vacuum cleaner comprises a duct connectable to a source of pressure air, and for leading the air to an air driven power source, a drive line for directing drive from the power source to an impact imparting element, a valve operable selectively to control flow of pressure air to the power source or to exhaust.

Conveniently, the source of pressure air is the electric motor driven fan of a conventional cleaner.

The unit according to the second aspect of the invention may form part of a cylinder or an upright cleaner. Where the unit forms a part of an upright cleaner, the valve is preferably operable according to the position of the handle. Where, however, the unit forms a part of a cylinder cleaner, the valve may be controlled by an operator remotely from the suction head. Control may, for example, be accomplished by a bowden cable or other linkage with a control unit located at a position convenient for the operator. It is unusual for the suction head of a cylinder cleaner to be fitted with an impact imparting element and it is a feature of the present invention to include such an element in the suction head and operated, albeit remotely, in the same manner as described above for an upright cleaner.

The invention also includes a method of powering a beating means of an upright vacuum cleaner comprising ducting a flow of air caused by an electric fan through a turbine and mechanically coupling the turbine to the beating means.

The method preferably includes automatically substantially preventing the flow of air through the turbine when the angle between a main body and a lower portion of the cleaner is within a predetermined range.

BRIEF DESCRIPTION OF THE DRAWINGS

The invention will now be described, by way of example, with reference to the drawings in which.

DETAILED DESCRIPTION OF THE PREFERRED EMBODIMENTS

In a conventional upright vacuum cleaner, a rotary beater is driven, via a belt, from a fan motor. This arrangement limits the choices of physical arrangements for the fan motor and beater. In a first embodiment of the invention, the rotary beater is driven by a turbine which is coupled via an air duct, to the exhaust outlet of the fan. This arrangement leads to a more flexible design of the product, less possibility of damage to the belt driving the beater and permits an air valve to be used to stop the beater when the cleaner is parked in the vertical position.

Figure 1:
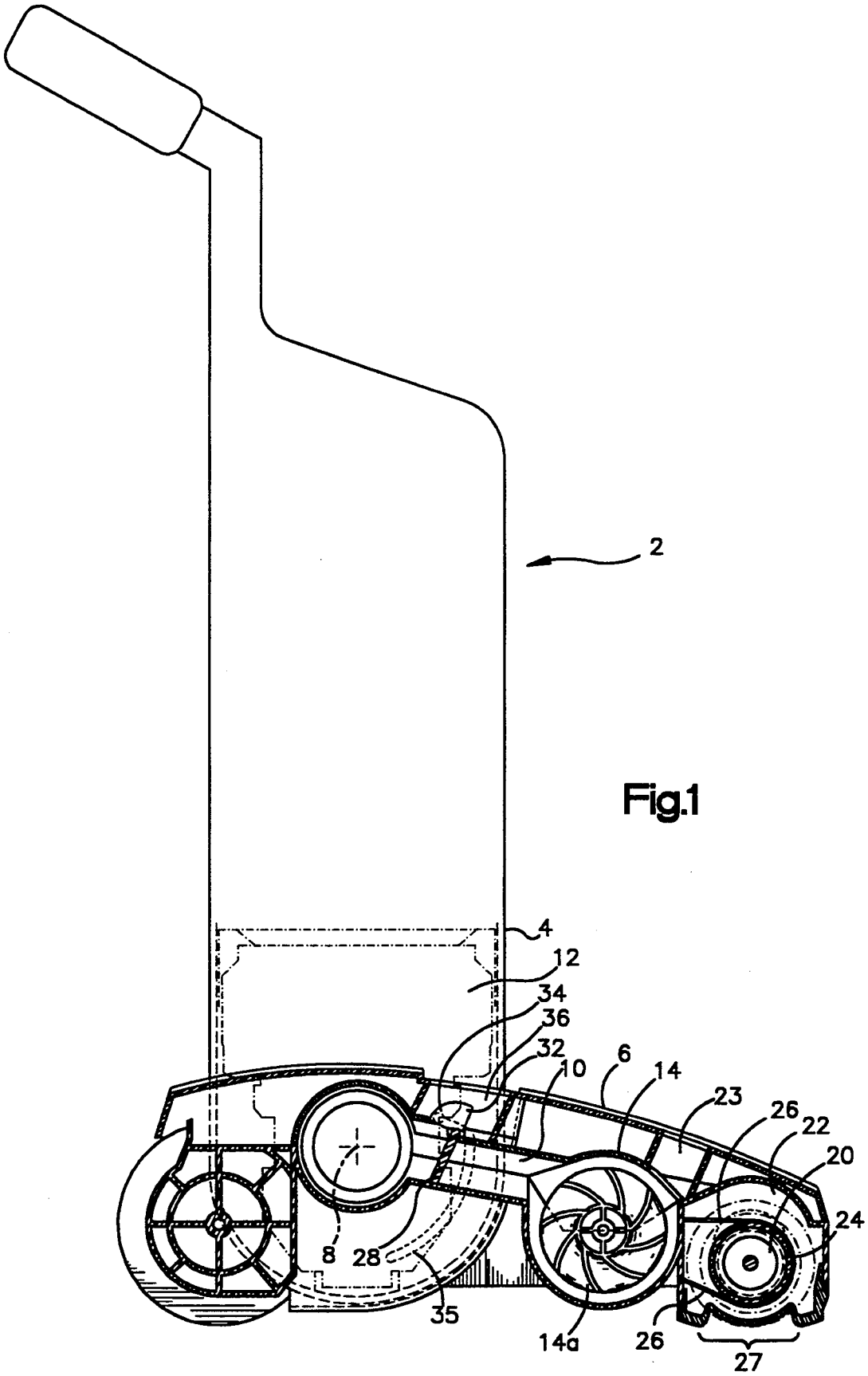
FIG. 1 shows a partial cross-section of an upright cleaner in accordance with the present invention.
Figure 2:
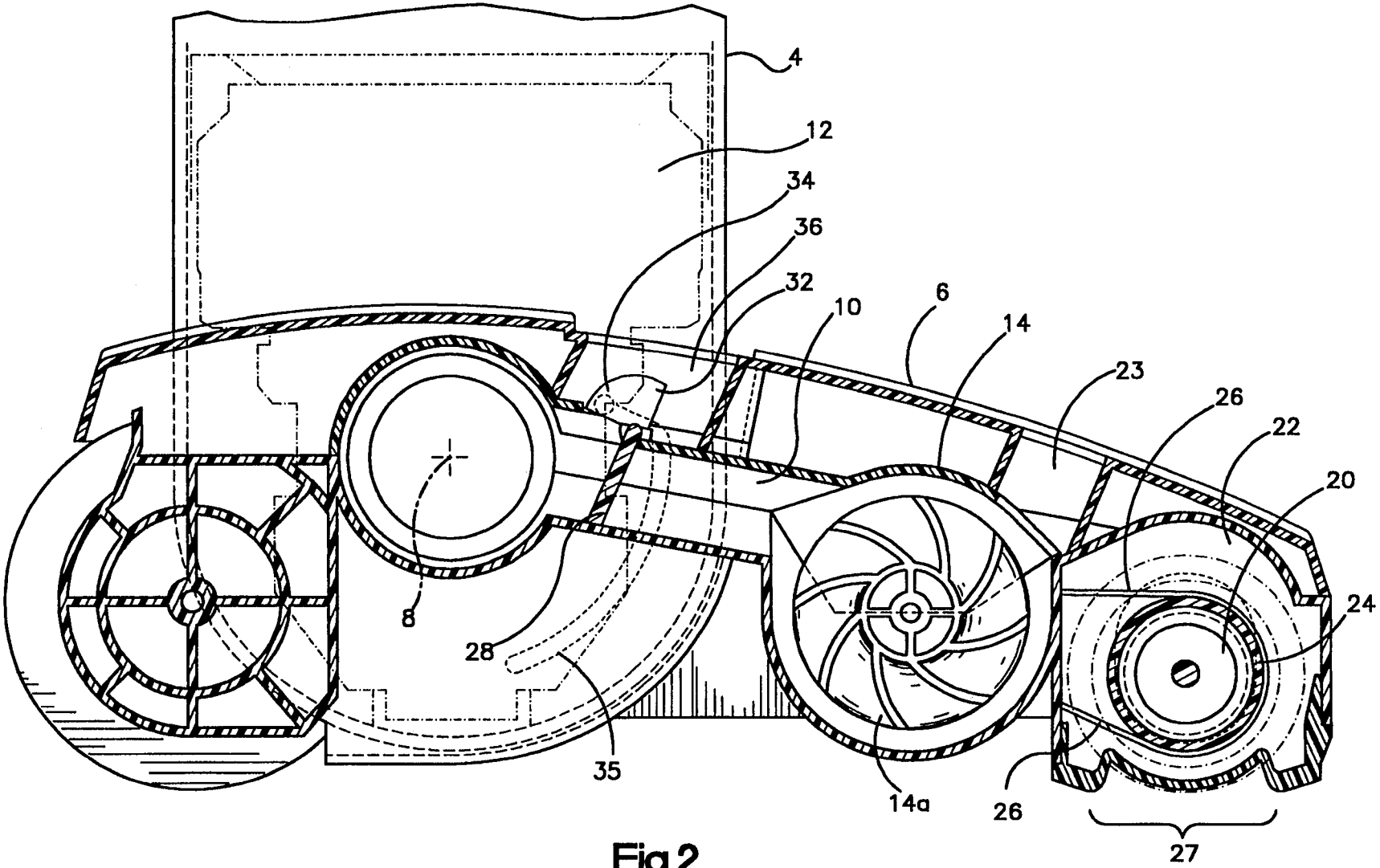
FIG. 2 is an enlarged view of the lower portion of the upright cleaner according to the present invention shown in FIG. 1.
Figure 3:
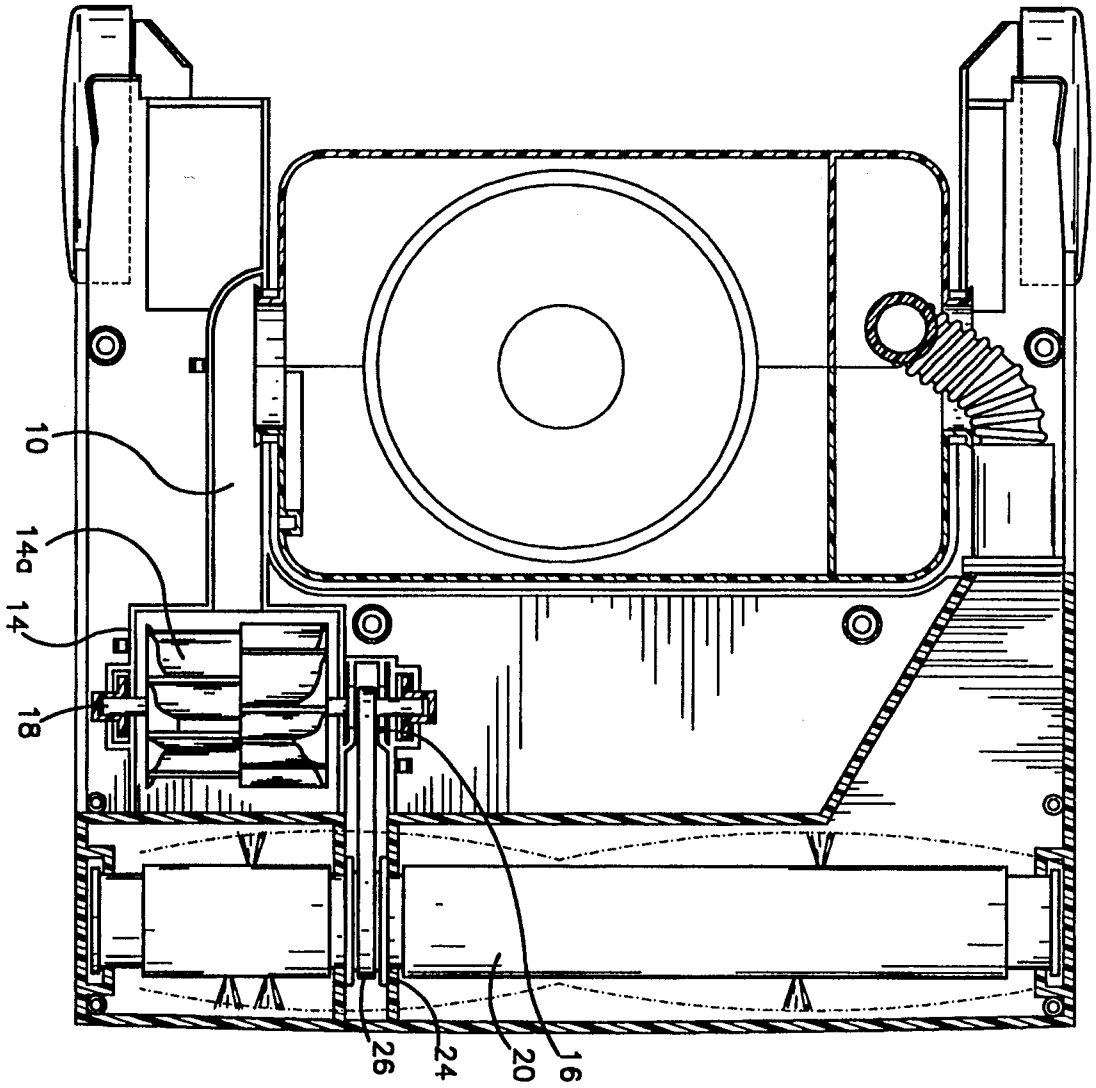
FIG. 3 shows a plan view of FIG. 2.

Referring to FIGS. 1 to 3, an upright vacuum cleaner 2 has a main body 4 and a lower portion 6 attached to the main body and pivotable about a pivot 8. A duct 10 conducts exhaust air from a fan housing 12 to a turbine 14. The fan housing contains a conventional electric fan (not shown) which draws air through a conventional filter and storage bag system (not shown) housed in the main body. A pulley 16 is mounted coaxially with turbine blades 14*a* and is arranged to rotate with the blades on a shaft 18. A cylindrical beater 20 is rotatably mounted in a vacuum chamber 22 adjacent the turbine and has a coaxial pulley 24 formed part way along its length. A belt 26 couples the pulleys 16 and 24 and transmits the rotation of the turbine blades to the beater.

In operation, air is drawn through a suction opening 27 into the vacuum chamber 22, past the beater 20 which when rotating, operates to release dust from the floor surface. The air is drawn into the filter and bag system so that the dust and debris from the floor is deposited in the bag. The air then passes through the fan housing and is exhausted through the duct 10, the turbine 14 and thence to the atmosphere through an aperture 23. The air flow causes the turbine 14 to spin which, by virtue of the belt and pulley system comprising pulleys 16 and 24 and belt 26, causes the 20 to rotate.

Figure 4:
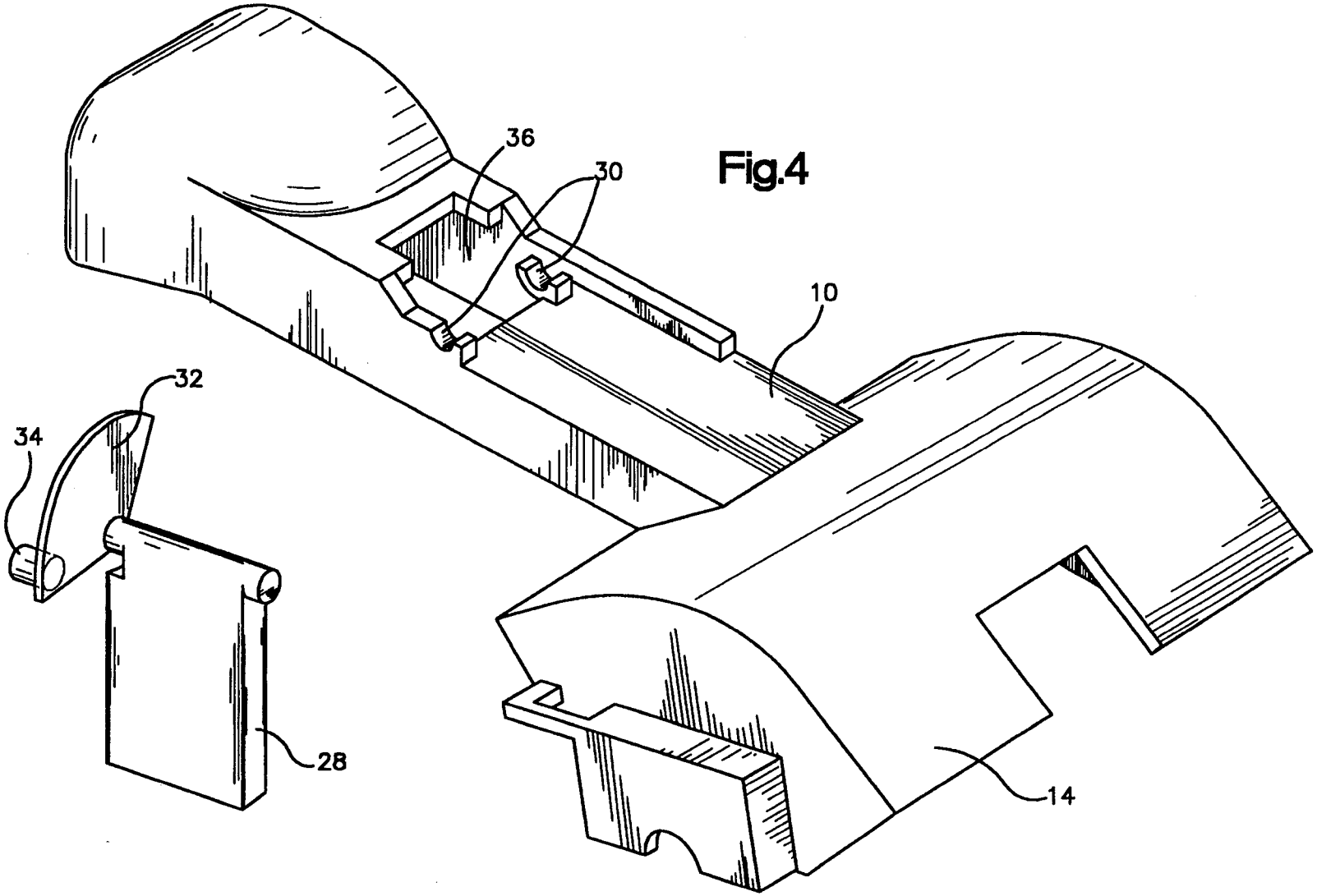
FIG. 4 is a perspective view of a turbine duct and valve flap in accordance with the present invention.
Figure 5A:
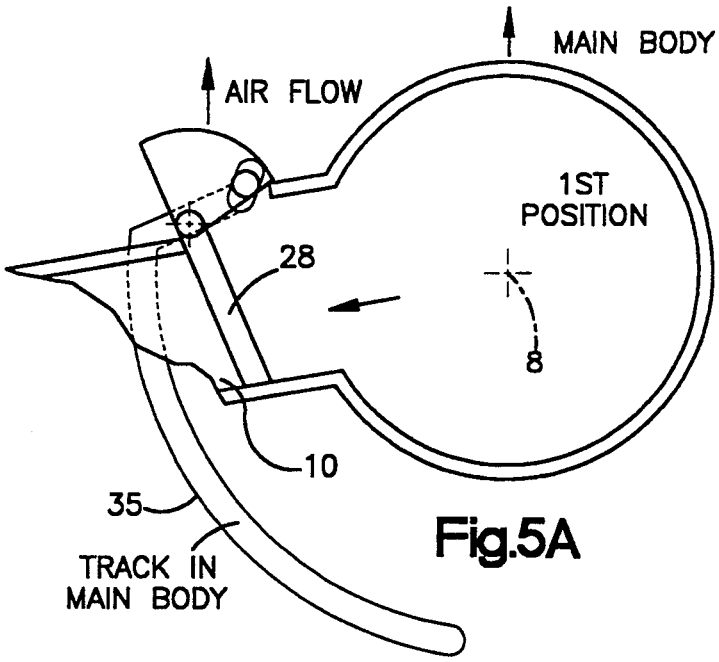
FIGS. 5*a* to 5*c* are schematic cross-sections of the turbine valve showing the valve in different positions.
Figure 5B:
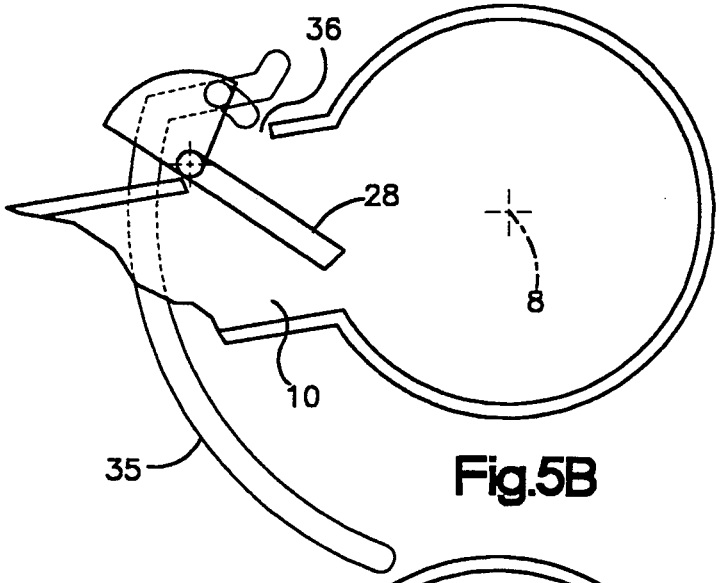
Figure 5C:
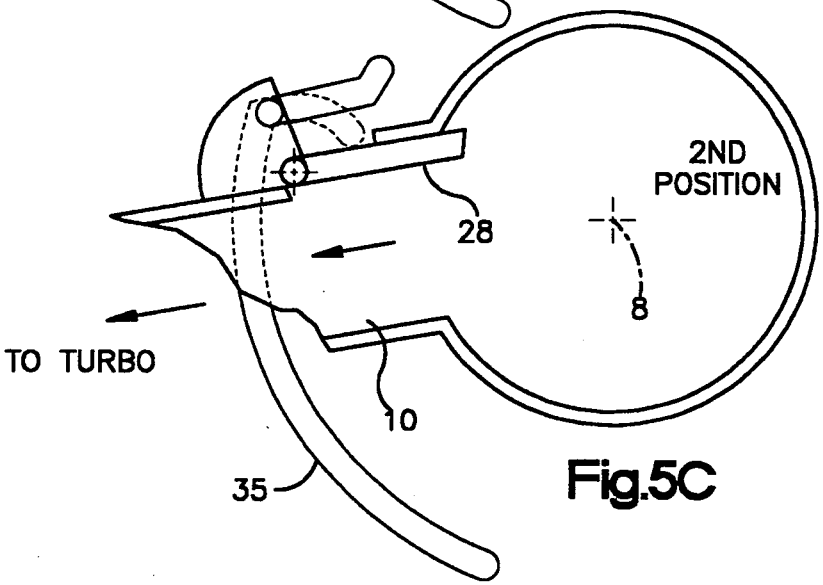

Referring to FIGS. 4 and 5*a*–5*c*, which show a second embodiment of the present invention, a flap 28 is pivotally mounted in the air duct 10 on fulcrum points 30 which are located in the upper wall of the duct. Attached to the upper part of the flap 28 and on one side thereof is a plate 32 with a cam peg 34 (FIG. 4). The cam peg 34 fits in and cooperates with a cam slot 35 formed in the main body 4 (FIGS. 5*a*–5*c*). When the main body is in an upright position in relation to the lower portion 6, the cam and peg ensures that the flap 28 is in a first position, as shown in FIG. 5*a*, wherein the flap 28 substantially blocks air flow between the fan housing 12 and the turbine 14 and redirects it through an exhaust aperture 36, to atmosphere. The turbine 14 is thus brought to rest and the beater stops rotating thus reducing wear on the floor surface when the cleaner is in a vertical 'parked' position. In use, the main body 4 of the cleaner 2 is displaced into an inclined position in relation to the lower portion 6. During inclination of the main body 4, the flap 28 gradually pivots as shown in FIG. 5*b*, until it assumes a second position as shown in FIG. 5*c*. In this position, the exhaust aperture 36 is closed and exhaust air flows from the fan housing, through the turbine and out through the aperture 23. The shape of the cam slot 35 is such that the flap 28 remains in the second position (FIG. 5*c*) for a wide range of inclination angles of the main body 4. Thus allowing for the varying heights of users and the variation in inclination as the cleaner is moved across the floor surface.

From the foregoing it will be appreciated that in a vacuum cleaner according to this invention the functions of air movement and the rotation of the rotary beater 20 are separated. This results in a more flexible product, less possibility of damage to the belt 26 driving the rotating beater 20 and gives a simple method of stopping the rotating brush when the vacuum cleaner 2 is parked in the vertical position.

Essentially the vacuum cleaner of the invention comprises a base having a front end and a rear end with a downwardly open suction opening adjacent its front end contact portions adapted for contact with the floor surface positioned around the suction opening and at the rear end of the base, a main body including a lower end portion pivoted to the base adjacent the rear end thereof and turnable about a horizontal axis with the main body movable between an upright first position and a second position in which the main body is inclined at an angle.

According to an embodiment of this invention, the suction opening is provided with auxiliary means such as a rotary brush or beater or like impact imparting element for releasing dust from the floor surface.

The rotatable beater may be driven by a belt connected to a turbine which is driven using the exhaust airflow from the fan unit located in the main body. This airflow is channelled to the turbine using a fixed duct in the base.

In the second position with the main body in an inclined position a valve or similar device situated in the airflow duct would be open thus allowing air unobstructed passage, so powering the turbine with the air then moving through an outlet 23 to atmosphere.

With the main body being moved into the first position this movement, to the upright position, will activate the valve 28 to close and so direct the airflow through exhaust outlet 36 and remove power from the turbine 14 thus allowing the rotatable beater 20 to stop.

In summary, therefore, it will be understood that not only does the exhaust air from the vacuum generator drive the turbine 14 and, hence, the rotatable beater but also that the air which flows by the rotatable beater passes directly into the dust collector without passing through the turbine.

Although specific reference has been made to the fact that the turbine 14 which is driven by cleaned exhaust air from the vacuum generator and, in turn drives the rotatable beater 20, the turbine 14 may also be used to perform additional drive functions. Such additional drive functions may be directed to drive units within the vacuum cleaner per se or accessories which can be detachably connected to the vacuum cleaner 2. For example, the turbine may be used to drive wheels supporting the cleaner through a drive line thereby assisting an operator during use of the cleaner. If desired, the dust collector bag may be operatively associated with a shaker or vibrator unit driven by the turbine so as to assist compaction of dust and debris collected in the bag. Thus, a larger quantity of dirt and debris will be collected in a collector bag than would otherwise be the case.

It is frequently required in both a domestic and an industrial/commercial environment that carpets and other floor coverings require to be cleaned using liquid cleaning preparation such as a detergent. The present invention also includes within its scope a vacuum cleaner having a reservoir for a liquid cleaning preparation, a pump for applying the liquid in the form of a stream or a spray through a nozzle head on to a surface to be cleaned wherein the pump is driven by the turbine 14. If desired, the wetted surface may be scrubbed using the rotable beater 20. Preferably, in the latter case, the vacuum cleaner includes means for selectively driving the pump and/or the rotatable beater. In order to reduce the weight of the vacuum cleaner during the normal suction cleaning mode, the reservoir and ancillary equipment may be constructed as an accessory for attachment to the cleaner.

It will be appreciated by those skilled in the art, that the system will operate using the air flow before it has passed through the bag and filter system. The above embodiments are however preferable because filtered air is passed through the turbine 14 which will reduce the risk of damage to the turbine 14 from abrasives and other debris.

We claim:

1. A vacuum cleaner comprising a main body, a first portion angularly displaced with respect to the main body and including a suction opening adjacent a beating means, an electric fan, a housing for the electric fan, a turbine, an air duct having a first aperture connecting the duct to the housing of the electric fan and a second aperture connecting the duct to the turbine, whereby exhaust air from the fan is directed throughout the duct to the turbine, a driving connection between the turbine and the beating means, a valve disposed in the duct and means for operating the valve to redirect air away from the turbine when said angle of displacement between the main body and the first portion falls within a predetermined range.

2. A cleaner according to claim 1 wherein the suction opening is arranged, in use, to be directed generally downwardly towards a surface to be cleaned.

3. A cleaner according to claim 1 wherein the air duct is connected at least in part between an air outlet of a dust collector and the turbine.

4. A vacuum cleaner according to claim 1 wherein the air duct contains a valve which will, when open, divert the airflow in the air duct so that it does not operate the turbine.

5. A vacuum cleaner according to claim 4 wherein the diverted air is exhausted from the machine.

6. A cleaner according to claim 4 wherein the flow of air passes through the fan before passing through the turbine.

7. A vacuum cleaner according to claim 4 wherein the air which passes through the turbine is exhausted from the machine.

8. A cleaner according to claim 1 wherein the valve is a flap.

9. A cleaner according to claim 8 wherein the flap is pivotally mounted about fulcrum points in the upper surface of the duct.

10. A cleaner according to claim 1 wherein the valve is open when the main body is substantially upright.

11. A cleaner according to claim 1 wherein the means for operating the valve is an activating means coupled with the main body.

12. A unit for use within a vacuum cleaner comprising a main body, a first portion angularly displaceable with respect to the main body and including a suction opening, a duct connectable to a source of pressure air, and for leading the air to an air driven power source, drive means for directing drive from the power source to an impact imparting element, a valve operable selectively to divert said flow of pressure air way from the power source when an angle between the main body and the first portion falls within a predetermined range.

* * * * *

UNITED STATES PATENT AND TRADEMARK OFFICE

CERTIFICATE OF CORRECTION

PATENT NO. : 5,345,650

DATED : September 13, 1994

INVENTOR(S) : Downham et al.

It is certified that error appears in the above-identified patent and that said Letters Patent is hereby corrected as shown below:

Column 1, line 37, delete "it" and insert --such dust and dirt--;

line 39, delete "such dust and dirt"; and line 56, delete "being cleaned," and after "carpet" insert --being cleaned--.

Column 3, line 45, after "which" insert --,-- (comma); and line 53, after "the" insert --beater--.

Column 4, line 56, after "beater" insert --20--.

Column 6, line 40, (Claim 12, line 8), delete "way" and insert --away--.

Signed and Sealed this

Twenty-eight Day of February, 1995

*Attest:*

Bruce Lehman

BRUCE LEHMAN

*Attesting Officer*

*Commissioner of Patents and Trademarks*